US009027652B2

(12) United States Patent
Cherewyk

(10) Patent No.: US 9,027,652 B2
(45) Date of Patent: May 12, 2015

(54) METHOD FOR CONVEYING BALLS DOWNHOLE USING A BALL CARRIER MEDIUM

(75) Inventor: Boris P. Cherewyk, Calgary (CA)

(73) Assignee: Isolation Equipment Services, Inc., Calgary, Alberta ( * ) Notice: Subject to any disclaimer, the term of this patent is extended or adjusted under 35 U.S.C. 154(b) by 405 days.

(21) Appl. No.: 13/541,738

(22) Filed: Jul. 4, 2012

(65) Prior Publication Data

US 2013/0008666 A1 Jan. 10, 2013

Related U.S. Application Data

(60) Provisional application No. 61/504,291, filed on Jul. 4, 2011.

(51) Int. Cl.
*E21B 33/068* (2006.01)
*E21B 23/08* (2006.01)

(52) U.S. Cl.
CPC ..... *E21B 23/08* (2013.01); *E21B 33/068* (2013.01)

(58) Field of Classification Search
CPC ..... E21B 23/08; E21B 33/068
USPC ..... 166/373, 374, 383, 386, 193, 332.4
See application file for complete search history.

(56) References Cited

U.S. PATENT DOCUMENTS

| | | | | |
|---|---|---|---|---|
| 4,893,676 | A * | 1/1990 | Hill | 166/280.1 |
| 2004/0251018 | A1* | 12/2004 | McLeod et al. | 166/75.13 |
| 2011/0192613 | A1* | 8/2011 | Garcia et al. | 166/373 |

* cited by examiner

*Primary Examiner* — Brad Harcourt
*Assistant Examiner* — Steven MacDonald
(74) *Attorney, Agent, or Firm* — Goodwin Law; Sean W Goodwin

(57) ABSTRACT

A method is provided for safely delivering actuators such as balls from a ball injector to a downhole tool in a wellbore. A structure or carrier medium, such as a slug of gel or foam, is introduced to a bore of injector and the ball is injected into the bore for support by the carrier medium. A displacement fluid, such as fracturing fluid, is pumped into the wellbore to drive the carrier medium and ball. Each slug and ball can be retrieved at a ball catcher at the wellhead.

20 Claims, 12 Drawing Sheets

METHOD FOR CONVEYING BALLS DOWNHOLE USING A BALL CARRIER MEDIUM

CROSS REFERENCE OF RELATED APPLICATIONS

This application claims the benefits under 35 U.S.C 119(e) of U.S. Provisional Application Ser. No. 61/504,291, filed Jul. 4, 2011, which is incorporated fully herein by reference.

FIELD

Embodiments disclosed herein generally relate to a method for controlling the injection of actuators such as balls into a wellbore, such as drop balls, frac balls, and packer balls, for interacting with downhole tools, such as those used for actuating tools that allow select zones or zone intervals in the wellbore to be stimulated. More particularly, the embodiments include supporting balls in a carrier medium for transport in a conventional fluid stream to their respective downhole destinations.

BACKGROUND

It is known to conduct fracturing or other stimulation procedures in a wellbore by isolating zones of interest, or intervals within a zone, in the wellbore, using packers and the like, and subjecting the isolated zone to treatment fluids, including liquids and gases, at treatment pressures.

In a typical fracturing procedure for a cased wellbore, for example, the casing of the well is perforated to admit oil and/or gas into the wellbore. Fracturing fluid is then pumped into the wellbore and through the perforations into the formation. Such treatment opens and/or enlarges drainage channels in the formation, enhancing the producing ability of the well. For open holes that are not cased, stimulation is carried out directly in the zones or zone intervals.

It is typically desired to stimulate multiple zones in a single stimulation treatment, typically using onsite stimulation fluid pumping equipment. A series of packers in a packer arrangement is inserted into the wellbore, each of the packers located at intervals for isolating one zone from an adjacent zone. It is known to introduce a ball into the wellbore to selectively engage one of the packers in order to block fluid flow therethrough, shift a sleeve to open ports for treatment or stimulation of an isolated zone uphole from a packer. Once the isolated zone has been stimulated, a subsequent ball is dropped to block off a subsequent packer, uphole of the previously blocked packer, for isolation and stimulation thereabove. The process is continued until all the desired zones have been stimulated. Typically, the balls range in diameter from a smallest ball, suitable to block the most downhole packer, to the largest diameter, suitable for blocking the most uphole packer.

At surface, the wellbore is fit with a wellhead including valves and a pipeline connection block, such as a frac head, which provides fluid connections for introducing stimulation fluids, including sand, gels and acid treatments, into the wellbore. Conventionally, operators manually introduce balls to the wellbore through an auxiliary line, coupled through a valve, to the wellhead. The auxiliary line is fit with a valved tee or T-configuration connecting the wellhead to a fluid pumping source and to a ball introduction valve. The operator closes off the valve at the wellhead to the auxiliary line, introduces one ball and blocks the valved T-configuration. The pumping source is pressurized to the auxiliary line and the wellhead valve is opened to introduce the ball. This procedure is repeated manually, one at a time, for each ball.

Other alternative methods and apparatus for the introduction of the balls have included an array of remote valves positioned onto a multi-port connection at the wellhead with a single ball positioned behind each valve. Each valve requires a separate manifold fluid pumper line and precise coordination both to ensure the ball is deployed and to ensure each ball is deployed at the right time in the sequence, throughout the stimulation operation. It is known to feed a plurality of perforation-sealing balls using an automated device as set forth in U.S. Pat. No. 4,132,243 to Kuus. Same-sized balls are used for sealing perforations and are able to be fed one by one from a stack of balls. The apparatus appears limited to same-sized balls and there is no positive identification whether a ball was successfully indexed from the ball stack for injection. In another prior art arrangement, such as that set forth in FIG. 1, a vertically stacked manifold of pre-loaded balls is oriented in a bore above the wellbore of a wellhead and frac head. Each ball is temporarily supported by a rod or finger. Each finger is sequentially actuated to withdraw from the bore when required to release or launch the next largest ball. As the balls are already stacked in the bore, the lowest ball (closest to the wellbore) is necessarily the smallest ball.

Applicant introduced a radial ball injector in U.S. Pat. No. 8,136,585, issued Mar. 20, 2012, the injector having a housing adapted to be supported on the wellhead. Each radial housing has an axial bore and at least one radial ball array having two or more radial bores extending radially away from the axial bore and fluidly connected therewith. The axial bore is aligned with the wellbore. Each radial bore houses a ball cartridge. Each radial bore has an actuator for actuating the ball cartridge. The ball cartridge is movable along the radial bore for extending into and retracting from the axial bore. The ball cartridge receives, stores, and releases balls. More than one radial ball array can be vertically stacked one on top of another to increase the number of balls available for wellbore operations. A radial ball array can be housed in a radial housing. Alternatively, more than two radial ball arrays can be vertically arranged within a radial housing. In each case, the axial bore of each of the radial housing is aligned with one another and with the wellbore.

Regardless of the means for introducing the ball, an operator cannot be assured of the ball's successful introduction to the wellbore, or the timing in which the ball reaches the downhole tool, or the safety and integrity of the ball.

As the majority of the sand-laden fracturing fluids are introduced at the frac head below the ball injectors, there can be an accumulation of sand formed in the bore at the interface of the ball injector and the frac head.

Typically, to reduce the effect of direct impingement of the fracturing fluid on the frac head, frac fluid can be introduced to the frac head from opposing inlets. As these high velocity fluid streams impact one another in the main bore of the frac head, a vortex of fracturing fluid can be created in an upper portion of the bore, which can result in an accumulation of sand or other particulates at the injector, the accumulation potentially impeding ball injection.

Further, as shown in FIG. 5, in undulating horizontal wellbores, sand can accumulate in low spots, potentially impeding the progress of a dropped ball from reaching its destination. Restrictions can also occur at the heel or flow dynamics can trap a ball at flow discontinuities such as the heel or joints as well as the aforementioned surface equipment side ports.

These trap zones or accumulations can impede, delay or prevent introduction of the ball into the frac fluid flow or delivery downhole.

As a result, balls can be impeded from entering the wellbore, and for those balls that do successfully enter the wellbore, these can be impeded from reaching their desired and intended location, such as downhole tools.

Further, it is not uncommon for a ball to be damaged or to disintegrate enroute or upon arrival at the downhole tool requiring a replacement ball or one of the same diameter to be launched again. Some apparatus requires depressurization and reloading of balls. This requires time consuming and properly managed procedures to maintain safe control in a hazardous environment and to complete testing and re-pressurization procedures upon reinstallation to the wellhead. The pumping of displacement fluid, such as fracturing fluid, through the ball injector unit can also damage or scar balls, especially if the displacement fluid is sand-laden fracturing fluid. Damaged and scarred packer balls typically fail to isolate the zone requiring an operator to then drop an identical ball down the bore of the injector.

Some injector apparatus, lacking backup balls, can require the entire unit to be removed, the replacement ball dropped, the unit reassembled, and pressure tested. This is extremely inefficient, time consuming, costly and can adversely compromise the treatment. Some methods require several balls to arrive at a multi-port packer basically at the same time. In such a multi-port packer, if some ports close and one of the multi-port remains open, the increased surge of fluid travelling therethrough will erode the orifice very quickly.

Further, other actuators such as a dart and the like are also dropped into a wellbore for actuation of various tools such as packers, landing nipples and circulation subs.

There remains a need for a methodology for delivering dropped balls safely and reliably downhole.

SUMMARY

Generally, as described herein, free-falling actuators, such as balls and darts are conveyed downhole, supported in a carrier medium like a sabot. Delivery of the carrier medium and actuator is controlled by control of a displacement fluid. The carrier medium protects the actuator, or actuators carried therein, and ensures a predictable arrival of the actuator at the tool, predictable both in arrival time and actuator integrity.

In one aspect, a method is provided for delivering at least one actuator, such as a ball, to a downhole tool positioned a wellbore, comprising supporting the at least one ball with a carrier medium, and pumping a displacement fluid into the wellbore for transporting the carrier medium and the supported at least one ball down the wellbore to the downhole tool.

In one aspect, the carrier medium is provided as a slug, the actuator being supported on or within the slug.

In another aspect the actuator is retrieve at a catcher at surface, the actuator supported still by the carrier medium.

DETAILED DESCRIPTION OF THE PREFERRED EMBODIMENTS

As described herein, free-falling actuators, such as drop balls, frac balls, packer balls, darts and other actuators, are generally released into a wellbore for falling through wellbore fluid, pumped or otherwise being conveyed to a downhole tool, for interacting therewith, such as to actuate the tool's function. In the prior art, the actuator is released and is subject to the vagaries of the wellbore environment including the wellbore itself, obstructions and fluid characteristics. Herein, the actuator is supported by a carrier, the carrier being a medium such as a gel of other supporting structure acting like a sabot for safe delivery of the actuator to a destination. The delivery of the carrier medium and actuator is dictated by the flow and control of a displacement fluid down the wellbore. The carrier medium supports the ball so that the displacement fluid is the actor causing transport of the ball downhole; basically when the fluid flow stops, the medium and supported ball stops. The carrier medium protects the actuator or actuators carried therein and ensures a predictable arrival at the tool, predictable both in arrival time and actuator integrity. Further, during retrieval, the carrier medium aids to space successive ball returns and in avoid ball jams. Herein the actuator is typically referred to in the context of ball injectors and ball although darts and other actuators that are dropped into a wellbore can benefit equally from the methodologies employed herein.

Figure 1:
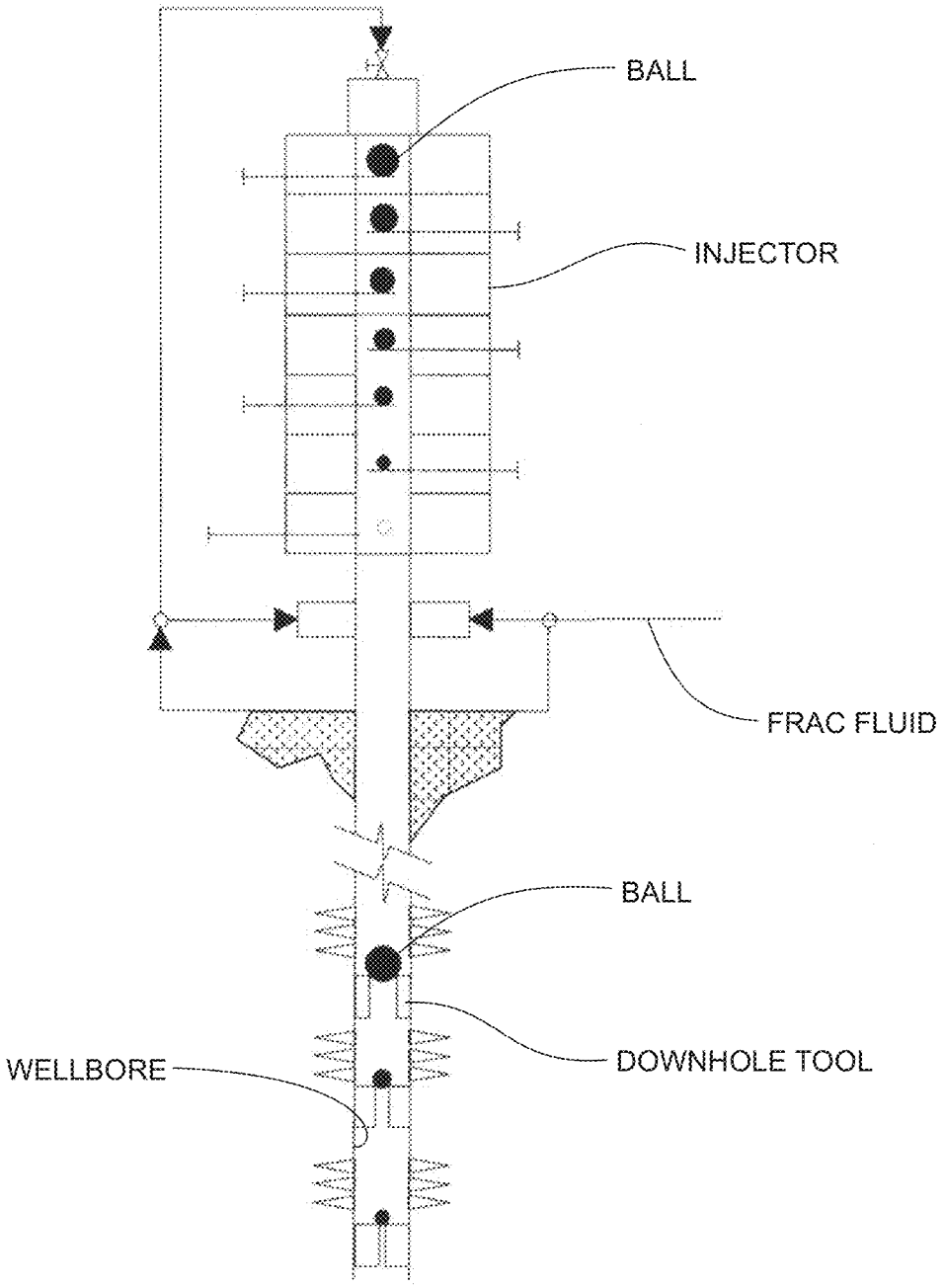
FIG. 1 is a cross-sectional view of a ball injecting apparatus illustrating vertically stacked manifold of pre-loaded balls oriented in a bore above a wellbore of a wellhead and frac head.
Figure 2:
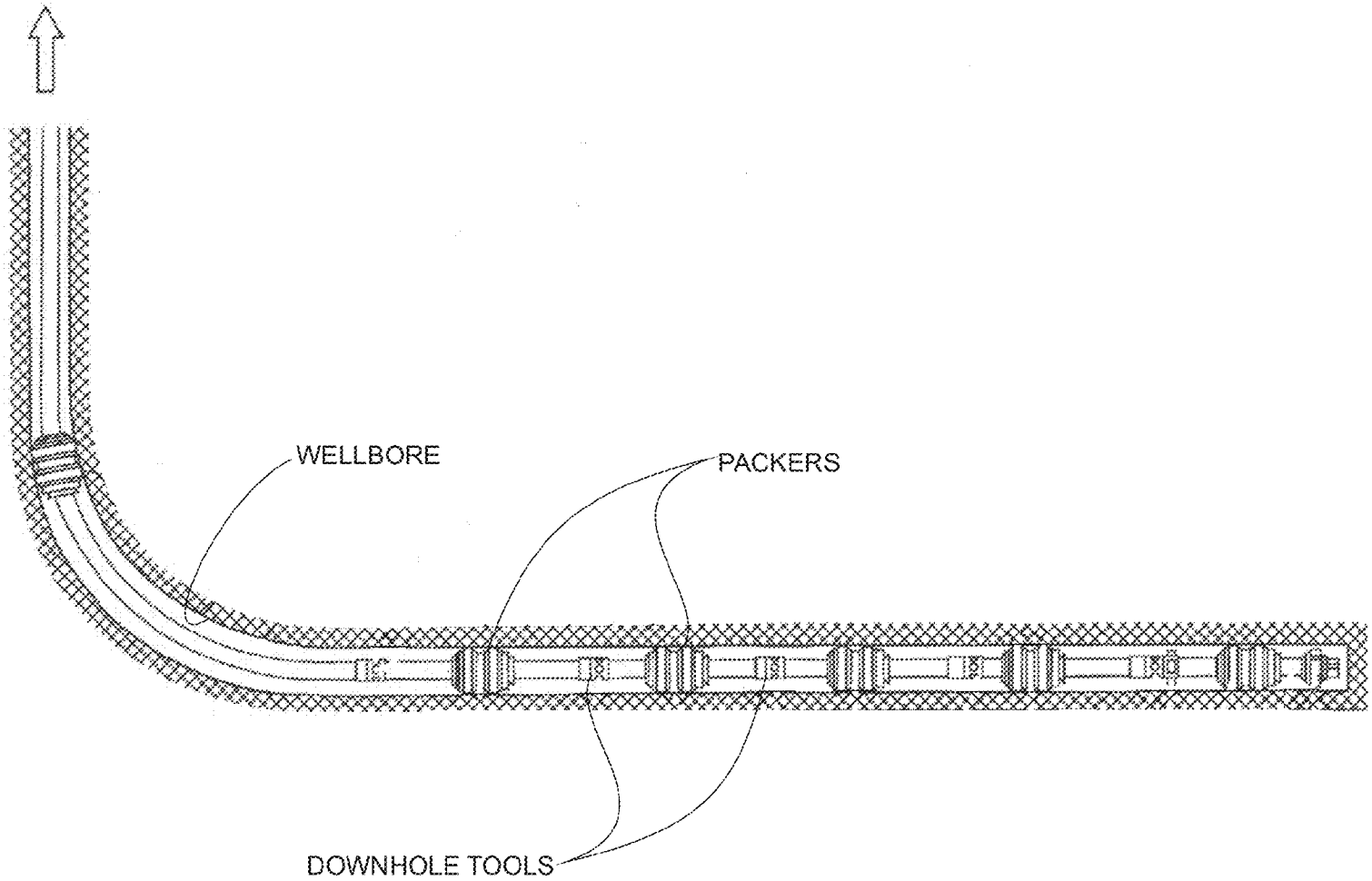
FIG. 2 is a cross-sectional view, from U.S. Pat. No. 6,907,936 to Fehr et al., illustrating a vertical well kicking off at a heel to a horizontal portion having multiple packers and sliding sleeves therebetween for selectively accessing a formation.
Figure 3:
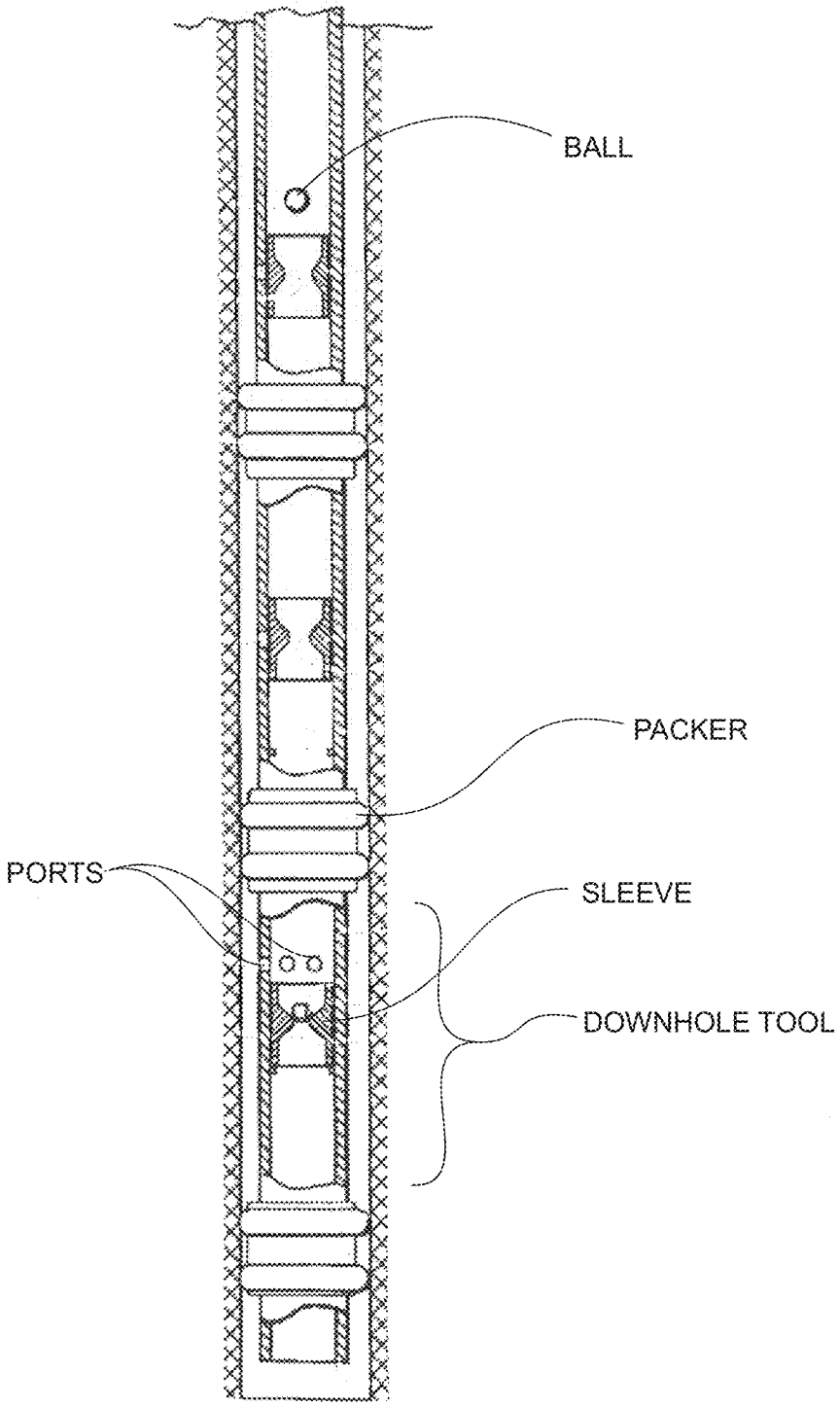
FIG. 3 illustrates a partial cross-section of the well of FIG. 2, illustrating a lower sleeve having been actuated by a first ball and an intermediate sleeve about to be actuated by a second ball for serially accessing a formation.
Figure 4A:
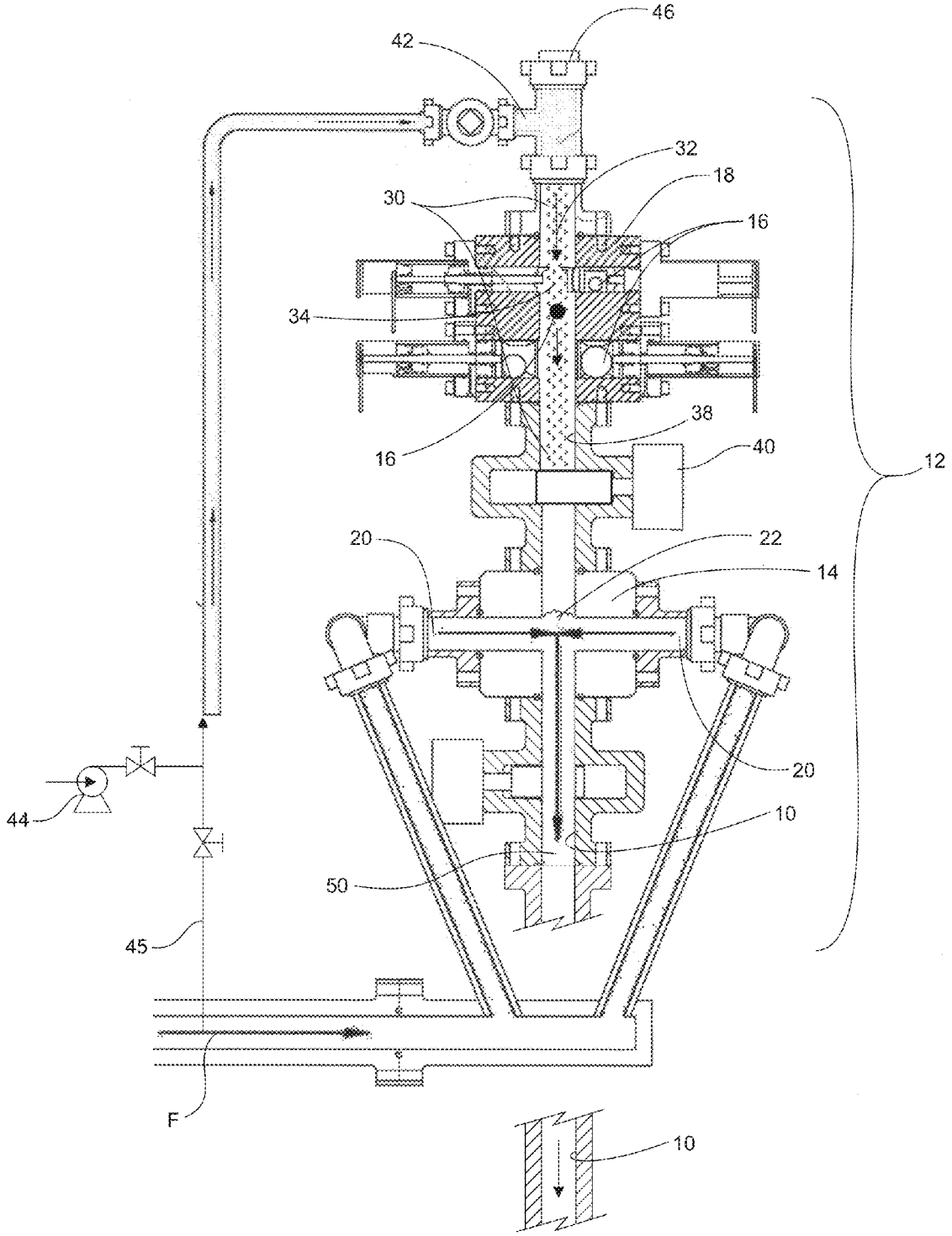
FIG. 4A is a cross-sectional view of a vertically stacked pre-loaded radial ball injector, as disclosed in Applicant's U.S. Pat. No. 8,136,585, issued Mar. 20, 2012, the injector being fit with a designated line for introduction of a ball carrier medium.

As shown in FIG. 4A, to access a wellbore 10, a wellhead 12 is provided such as that including a buffalo head, fracturing head or frac head 14 for introducing fracturing fluid to the wellbore. Further, a ball injector 18 is provided for introducing an actuator, such as a ball 16, into the wellbore 10. One form of ball injector 18 is a vertically stacked pre-loaded radial ball launcher of a form as disclosed in Applicant's U.S. Pat. No. 8,136,585, issued Mar. 20, 2012, and which is fully incorporated herein by reference.

In a conventional hydraulic fracturing or "frac" operation, a fracturing fluid F is injected downhole into the wellbore 10 through two opposing side fluid ports 20,20 of the frac head 14. Downhole tools, such as sliding sleeves, are designed to pass fluid therethrough until the receipt of an actuator such as a ball, which blocks a port in the sleeve. Fluid pressure releases and shifts the blocked sleeve to open ports and access the formation outside the wellbore 10.

Figure 5:
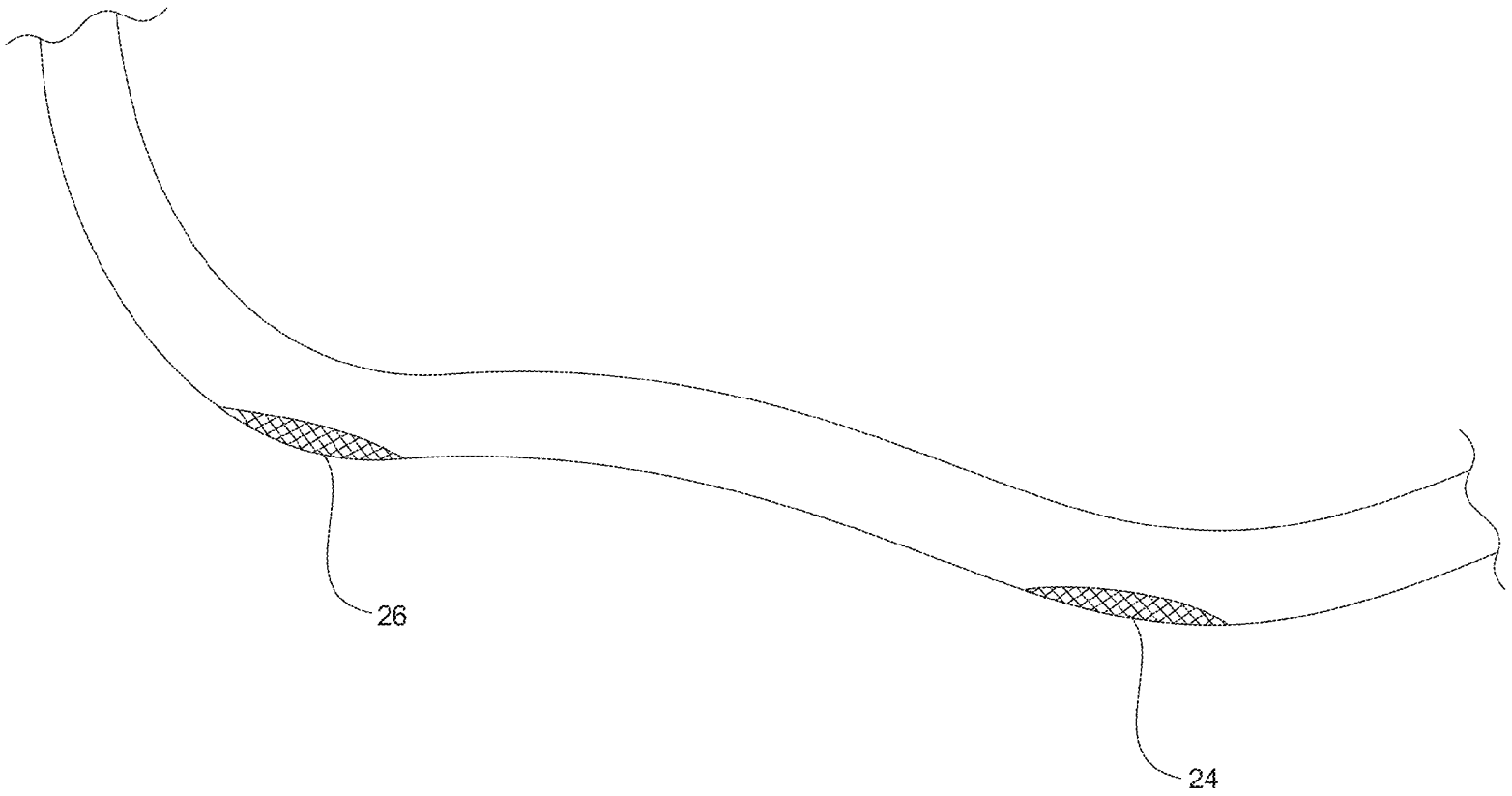
FIG. 5 illustrates a typical horizontal wellbore kicking off from a vertical wellbore at a heel, the horizontal wellbore portion containing at least one low spot accumulating sand.

In the prior art, the ball 16 falls through the fluid F and the fluid can be pumped to aid the ball's transport downhole. The release, transport and receipt of the ball can be adversely influenced by the fracturing fluid and by the wellbore characteristics between the release and receipt of the ball. Adverse influences include the unknown fall rate of the ball through the fluid and buildup of fracturing sand in eddies and low spots in the wellbore. At the wellhead it is believed that the vortex of opposing streams of incoming fracturing fluid at the frac head 14 resulting in an accumulation of sand in dead-spots. Temporary bridges 22 can form at normally-dead flow zones, above the side inlet ports 20,20, which can impede ball injection into the wellbore 10. Further, and with reference to FIG. 5, Applicant believes that debris and sand can also accumulate, downhole of the frac head 14, in low spots 24 in horizontal wellbores, or heels 26 or other locations of a wellbore 10. Accumulation of sand can impede the travel of a ball 16 dropped or injected from the surface.

Accordingly, to overcome this or other difficulties encountered in injecting balls downhole discussed below, an actuator carrier medium 32 is introduced to at least travel in advance of the actuator for support and transport of the actuator past trouble spots and at a predicable rate dictated by the volume of displacement fluid delivered downhole.

Returning to FIG. 4A, a slug 30 of carrier medium 32 is introduced to the wellhead 12 at, or downhole of, an actuator injection point 34. As shown in this embodiment, the actuator injection point 34 is at the ball injector 18 and the actuator is a ball 16. The injector 18 has a bore 38 in fluid communication with the wellbore 10. An isolation valve 40 isolates the bore 38 from the wellbore 10. The injector 18 can inject at least one ball 16,16 . . . . The slug 30 of carrier medium 32 can be introduced manually through an access port 42 or ports to the injector 18 or automated such as via a separate dedicated pump 44. A top 46 of the injector can be access for introducing a carrier including if the nature of the carrier medium is that it is not processable through a pump including a sponge or foam medium. The carrier medium 32 forms the slug 30, which is axially extending and which supports the ball 16 during transport down the wellbore 10.

The carrier medium 32 is a structure sufficient to support the ball 16 therein or thereabove. A deformable structure, such as a foam, viscous fluid or gel has the structure necessary to support a ball and yet be driven down and back up a wellbore using a displacement fluid. Foam plugs or pigs are known in the pigging industry for swabbing or cleaning tubular components. A foam pig is transported by a displacement fluid. The carrier medium 32 can be a slick gel as is known in the fracturing art. A gel form of carrier medium 32 can be complexed or formed as viscous or dense as necessary to maintain the ball suspended therein so as move substantially as a whole during transport. Those of skill in the art can ascertain the carrier medium characteristics suitable so as to support a ball of known mass and dimensions in suspension. The ball 16 is supportably retained upon or in the carrier medium 32 during transport through the wellbore 10 to a downhole tool.

At least a portion of the slug 30 of carrier medium 32 is positioned downhole of the injection point 34 and the ball 16 is injected into or above the carrier medium 32. An additional slug 20 or slugs of carrier medium 32 can be introduced after the ball 16 is injected. The carrier medium 32 protects and supports the ball 16 from at least below the ball 16, or even encapsulating the ball 16 therein. The positioning of the slug 30 of carrier medium 32 can be manipulated by the use of the introduction of displacing fluids and valve operation. In fracturing operations, where fracturing fluids are pumped substantially continuously downhole, a pressure-balanced bore 38 of the injector 18 and wellbore 10 is established and a slipstream of the carrier medium, ball and chase fluid is applied to introduce the slug to the fracturing fluid. When introduced, the fracturing fluid F displaces the slug downhole. The flow of fracturing fluid is typically reduced temporarily during ball injection which also assists in maintaining the integrity of the slug 30 for conveyance downhole as a whole, downhole.

The slug 30 of carrier medium 32 and at least one ball 16 are injected into the wellbore 10 by pumping the displacement fluid F from uphole of the slug 30, driving the carrier medium 32 and supported ball 16 downhole. As shown, the carrier medium 32 and ball 16 can initially be jockeyed to a position downhole of the frac head. Pumped displacement fluid F, such as fracturing fluid, is used to displace the slug 30 downhole to the downhole tool. The carrier medium 32, under the influence of the displacement fluid F, travels with and ahead of the ball 16 for managing ball transport including: controlling the transport velocity of the ball, protecting the ball, and ensuring that a portion of the wellbore 10 ahead of the injected ball 16 is substantially unimpeded by accumulations or movable obstructions.

In the case of a gel slug, the dedicated pump 44, such as a positive displacement pump, can inject a sufficient volume of gel necessary to support or surround the ball 16. Alternatively, the pump 44 can inject a complexing additive sufficient to cause gelling of a passing base fluid, timed to intercept an injected ball 16 at the injector 18.

In an embodiment, the bore 38 of the ball injector 18 is isolated from the wellbore 10 and the carrier medium 32 and ball 16 are introduced. In an alternate embodiment, the injector is open to the wellbore and the carrier medium is introduces under wellbore conditions. A first block or volume of the carrier medium 32 is introduced into the bore 38, such as from about a port 42 or top 46 of the injector 18, forming the axially-extending slug. The slug 30 is positioned, re-positioned or traverses at least below about the injection point 34 of the ball 16, through the manner of injection, timing or fluidly repositioned thereafter. The slug 30 can fill the bore 38 to about the isolation valve 40 which separates the bore 38 of the ball injector 18 from the frac head 14. The ball 16 can be injected into the bore 38 for positioning and support somewhere between an uphole end of the slug or intermediate therein. In an embodiment, the slug 30 can envelope or encapsulate the ball 16 therein such as by injecting the ball 16 intermediate the slug or by adding a second volume of carrier medium, after ball injection, above the first block or volume. A carrier medium or structure, deformable and pumpable downhole, also accepts injection of a ball therein.

The slug 30 of carrier medium and ball 16 therein is moved from the injector 18 and into the wellbore 10, for displacement downhole. If not open already, the bore 38 is opened to the wellbore 10 and the slug is displaced from the injector 18 and into the wellbore. The slug 30 of carrier medium 32 is displaced from the injector 18 such as by the addition of fluid from the pump 100, a slipstream or bypass stream of frac fluid F through bypass line 45, or other fluid means. Alternatively, gravity, a hydraulic plunger or mechanical device can be used to urge the slug of carrier medium 32 and supported ball 16 out of the injector 18 and into the wellbore 10.

Figure 6:
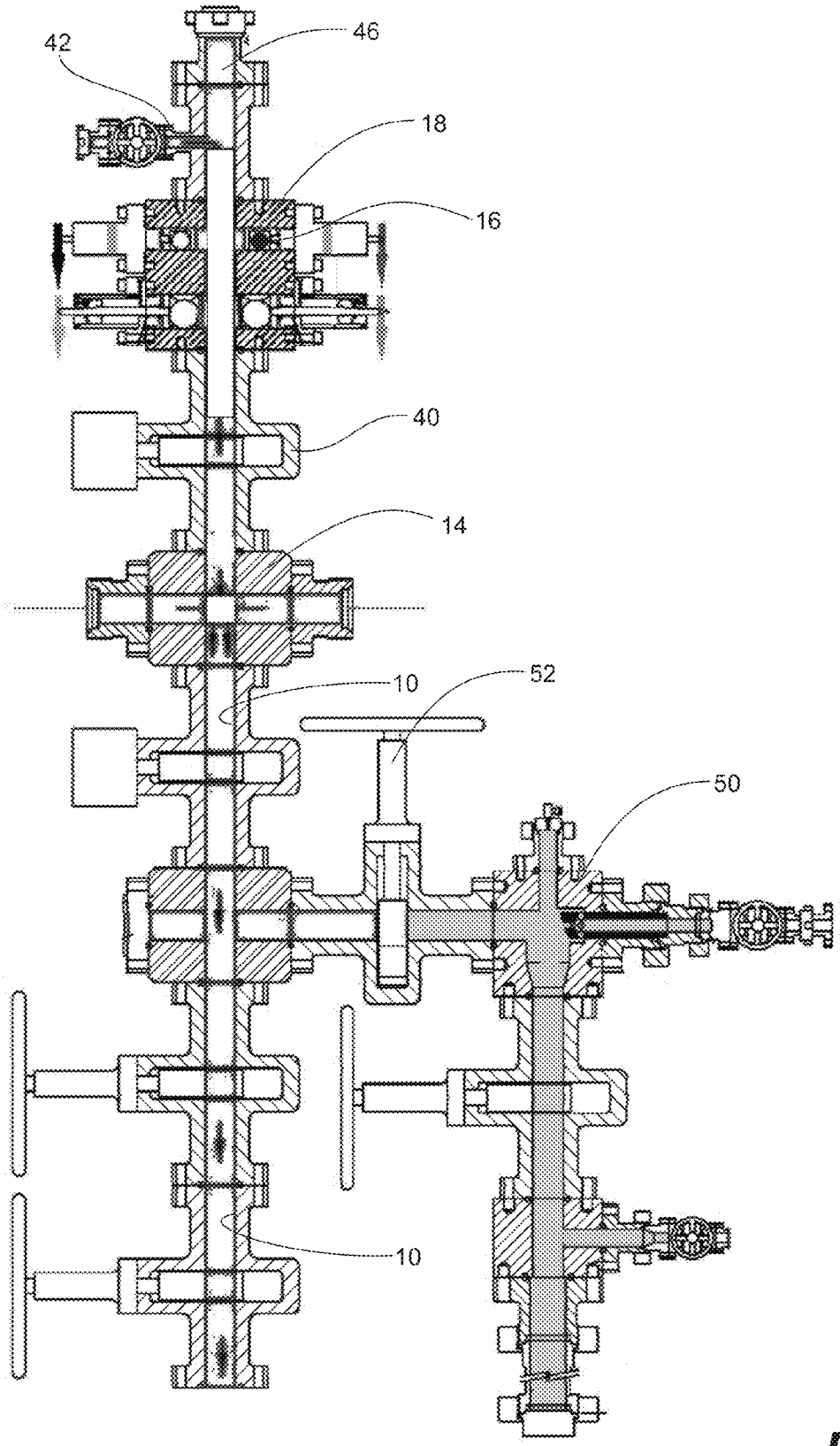
FIG. 6 is a cross-sectional view of a wellhead comprising the vertically stacked pre-loaded radial ball injector of FIG. 4A, secured on a frac head and fit with a ball catching system below the frac head.

With reference to FIG. 6, and in another ball injection and recovery embodiment, a ball catching assembly 50 is fluidly connected to the wellbore 10 downhole of the frac head 14 for catching one or more previously injected balls 16,16 . . . during ball retrieval. The ball catching assembly 50 can be isolated from the wellbore 10 by valve 52. The ball injector 18 is supported uphole of the frac head 14, has bore 38 in fluid communication with the frac head 14 and can be isolated therefrom by the isolation valve 40.

Figure 4D:
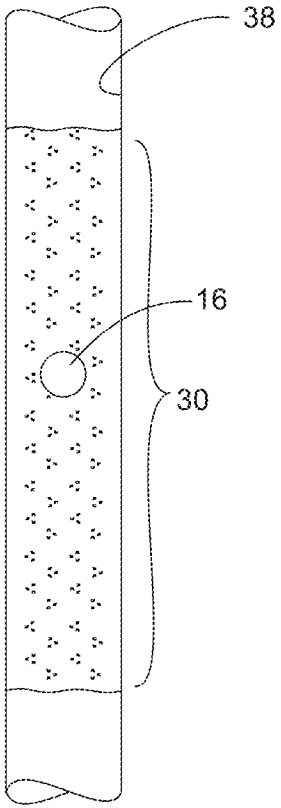
FIG. 4D is a cross-section of a slug having a ball encapsulated within.
Figure 4C:
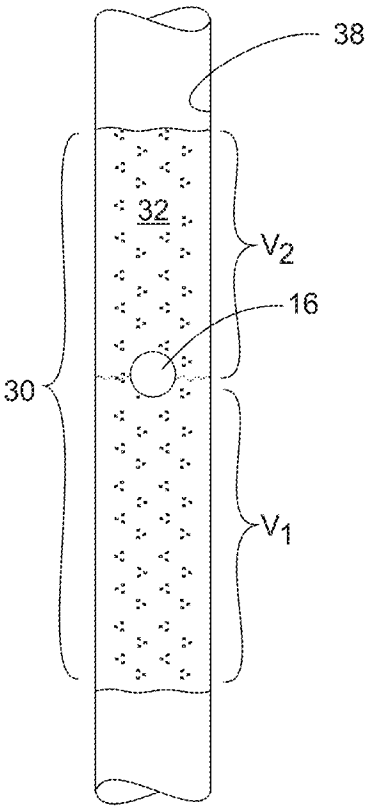
FIG. 4C is a cross-section of a slug comprising first volume of a carrier medium, a ball, and a second volume of the carrier medium thereabove for encapsulating the ball within.
Figure 4B:
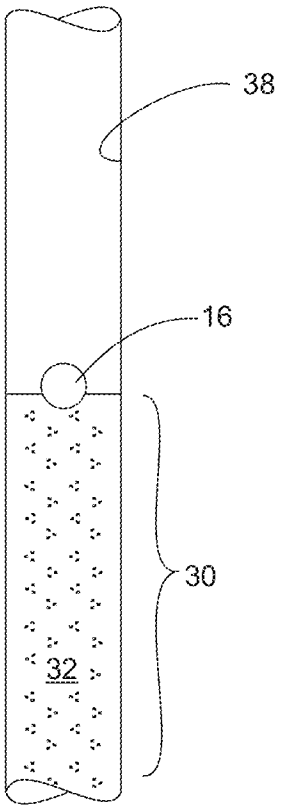
FIG. 4B is a cross-section of a slug having a ball supported therein.
Figure 7:
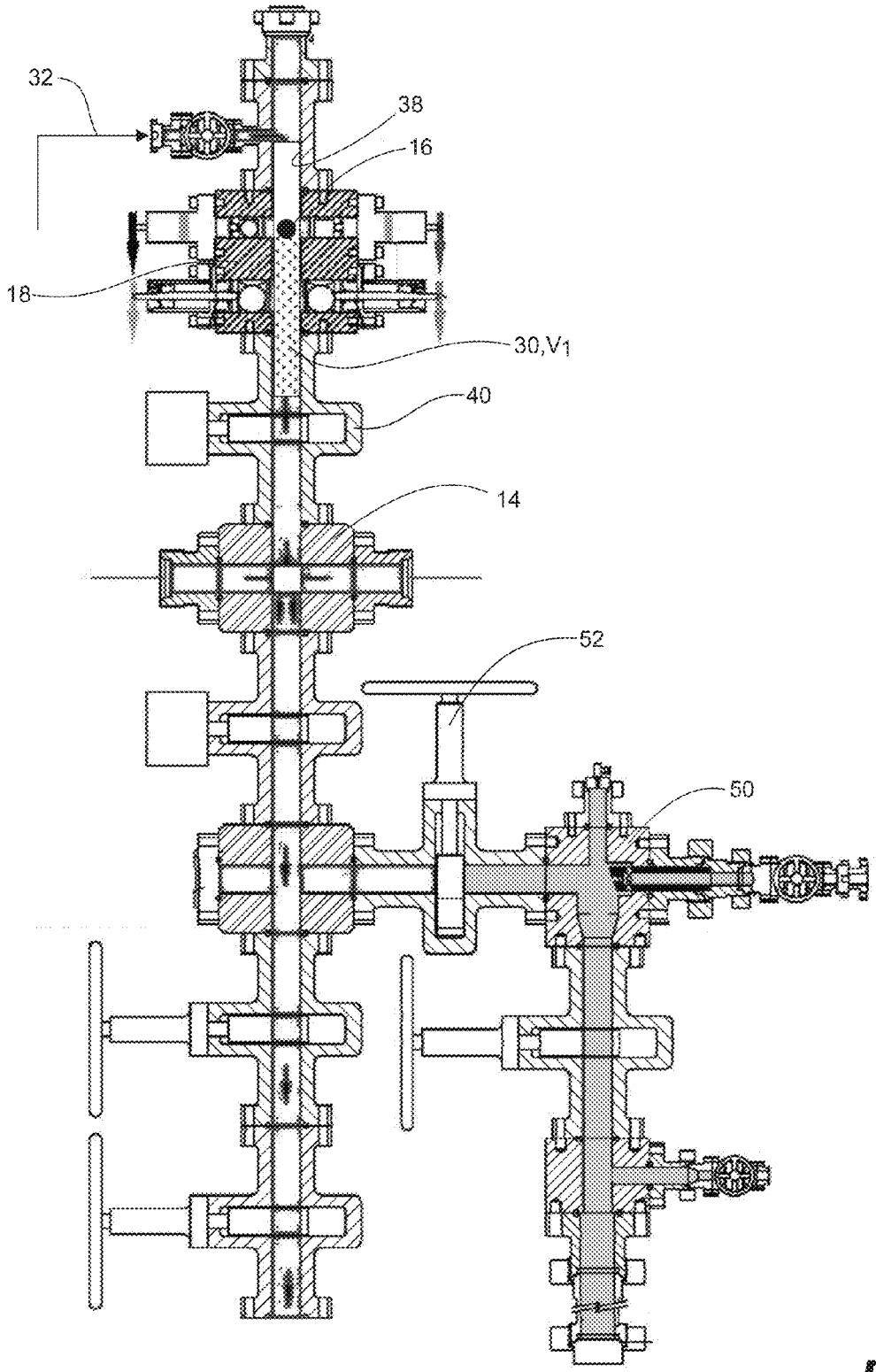
FIG. 7 illustrates the wellhead of FIG. 6 having received a slug of carrier medium and a ball supported thereon, the carrier medium and supported ball blocked in above an isolation valve.
Figure 8:
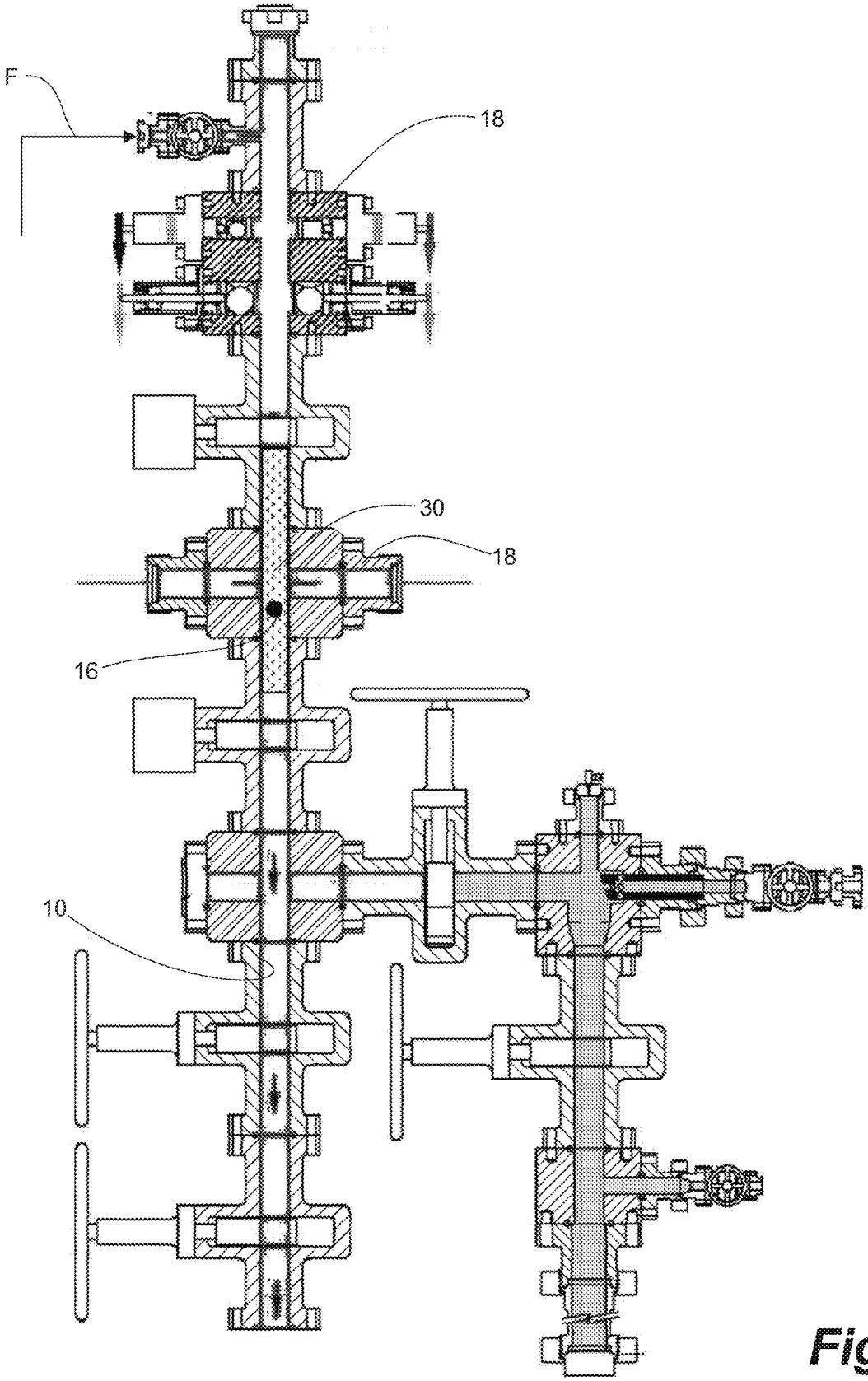
FIG. 8 illustrates the wellhead of FIG. 6 having the slug of carrier medium and supported ball displaced through an open isolation valve in preparation for displacement downhole.

In operation, and with reference to FIG. 7 at least a first block or first volume V1 or slug 30 of carrier medium 32 is introduced to the injector 18. As shown in FIG. 4B, a ball 16 is injected from injector 18 on top of the first volume V1. As shown in FIG. 4C, a second block or second volume V2 of the carrier medium 32 can be introduced thereafter. With isolation valve 40 open, the slug 30 is displaced into the wellbore 10. In FIG. 8, the slug 30 is positioned downhole of the frac head 14 for displacement downhole using fracturing fluid F.

In more detail, and returning to FIG. 7, when the injection of a ball 16 is required for wellbore operations, A first block or volume of carrier medium 32 is placed into the bore 38 of the ball injector 18. The ball 16 is positioned within the bore 38, uphole of the carrier medium 32 for support thereon as shown in FIG. 4B or injected intermediate the slug 30 as shown in FIG. 4D, to support the ball 16 encapsulated therein. In an embodiment shown in FIG. 4C, a second volume of carrier medium V2 can be placed after the ball 16 is positioned within the bore 38, encapsulating the ball 16 therein. Typically, an encapsulated ball 16 (FIGS. 4C and 4D) is intermediate the axially-extending slug 30. In embodiments, more of the carrier medium 32 is located downhole of the ball 16 than uphole thereof. In other embodiments, the ball 16 is positioned about ⅓ to ½ along the slug 30 from an uphole end.

Figure 9:
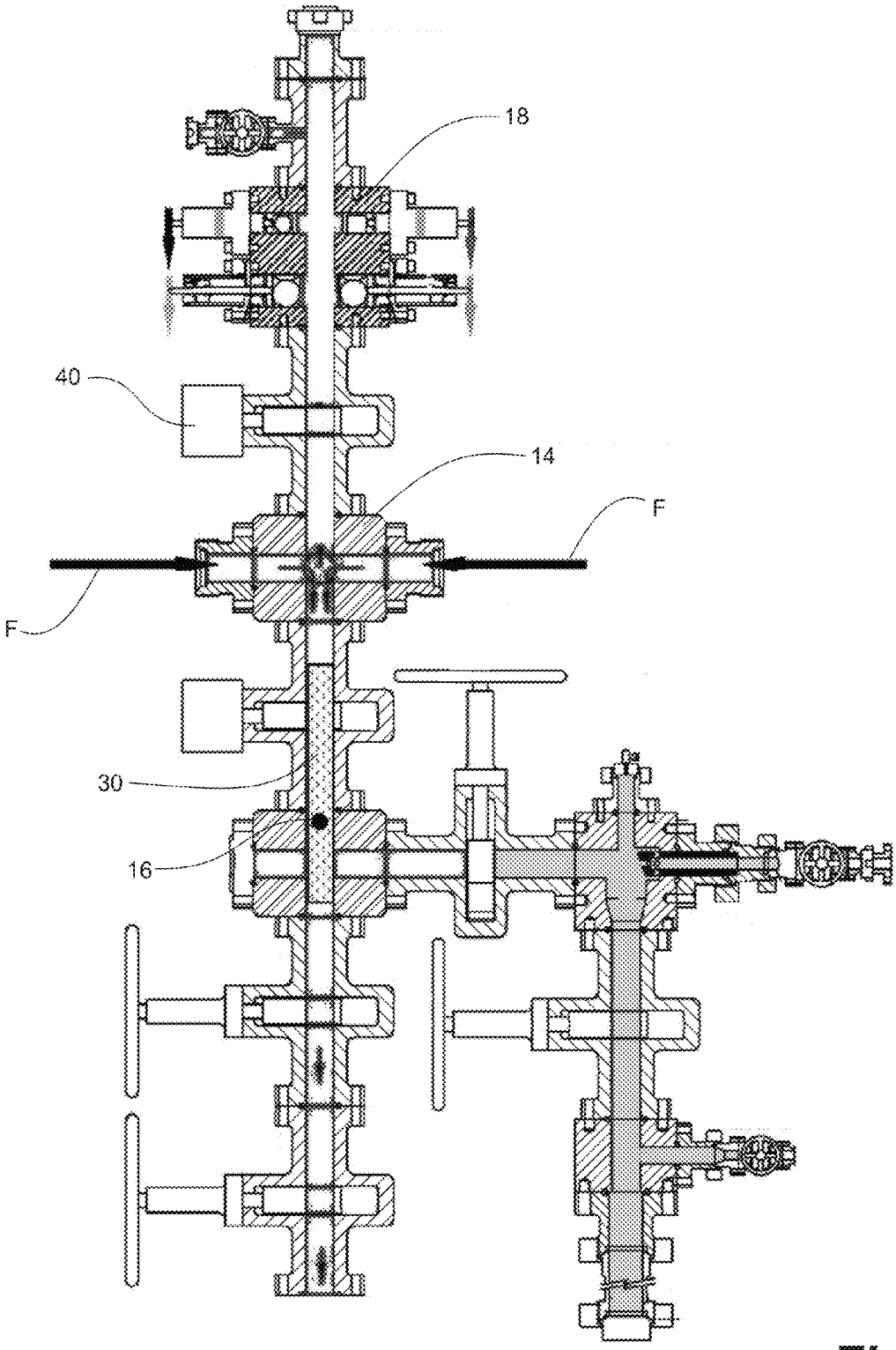
FIG. 9 illustrates the wellhead of FIG. 6 having the slug of carrier medium and supported ball displaced past the frac head for pumping downhole with a displacement fluid.

With reference to FIGS. 8 and 9, if the isolation valve 40 was closed, then pressure within the bore 38 of the ball injector 18 is equalized with a pressure of the frac head 14. A chase fluid, typically the same displacement fluid F such as the fracturing fluid, is introduced through the bypass line 45 or dedicated pump 44 to the injector 18 to chase or advance the slug 30 containing the ball 16 from the injector to the frac head 14.

As shown in FIG. 9, the slug is displaced to a position downhole of the frac head 14 to join transport downhole with the displacement fluid F. The slug 30 and injected ball 16 are displaced downhole by the displacement fluid. While often introduced from the injector 18 to the frac head on-the-fly with fluid F flowing downhole, the process can also be batched. It is believed that for a bore of 4.5 inches, and 3 to 5 $m^3$/min of frac fluid the flow conditions would be sufficiently calm to reduce the risk of breakup of the slug enroute to the downhole target. In a batch mode, with the fracturing or displacement fluid F off or in a slow flow state, the slug 30 is urged below the frac head 14, the remote valve 40 can be closed, and the displacement fluid F is re-introduced or increased to displace and transport the slug 30 and encapsulated ball 16 downhole. A measured introduction of the displacement fluid F can precisely position the slug 30 and ball 16.

The position of the slug 30 in the system can be determined using the measured volume of the displacement fluid F and the cumulative displacement volume of the system. A lineal volume of the wellbore 10, per lineal depth, and cumulative displacement volume of the system is established. A measured volume of displacement fluid F is pumped into the wellbore. One compares the measured volume of displacement fluid and a cumulative displacement volume of the wellbore to locate the ball carrier medium and the supported at least one ball along in the wellbore.

In an embodiment, the carrier medium 32 is a complexed gel commercially available for use in the oil and gas industry, which is injected or complexed at the ball injector 18 by the separate dedicated pump 44 (FIG. 4A). Based on the volume of the ball injector 18 and dimensions of connected components, operators can pre-calculate the number of positive displacement strokes to fill the injector 18, and thereafter to position the slug 30 from the injector to a position below the frac head 14. Hence carrier medium can be complexed and provided to the injection point 34 just-in-time to receive a ball 16 or positioned to inject the ball 16 at a specific location on or in the slug 30. The above is repeated for each device and ball set for actuation. In another embodiment, frac fluid is pumped through the bypass line 45 and complexing to increase its viscosity just prior to entering the ball injector 18.

Referring back to FIG. 5, in a horizontal leg of the wellbore 10, the horizontal section is quite often deviated and frac sand pumped from a previous operation can fall out of suspension. In this case, the slug 30 can act as a swab to remove the sand and other potential debris which can impede the timely transporting of the ball 16.

Figure 10:
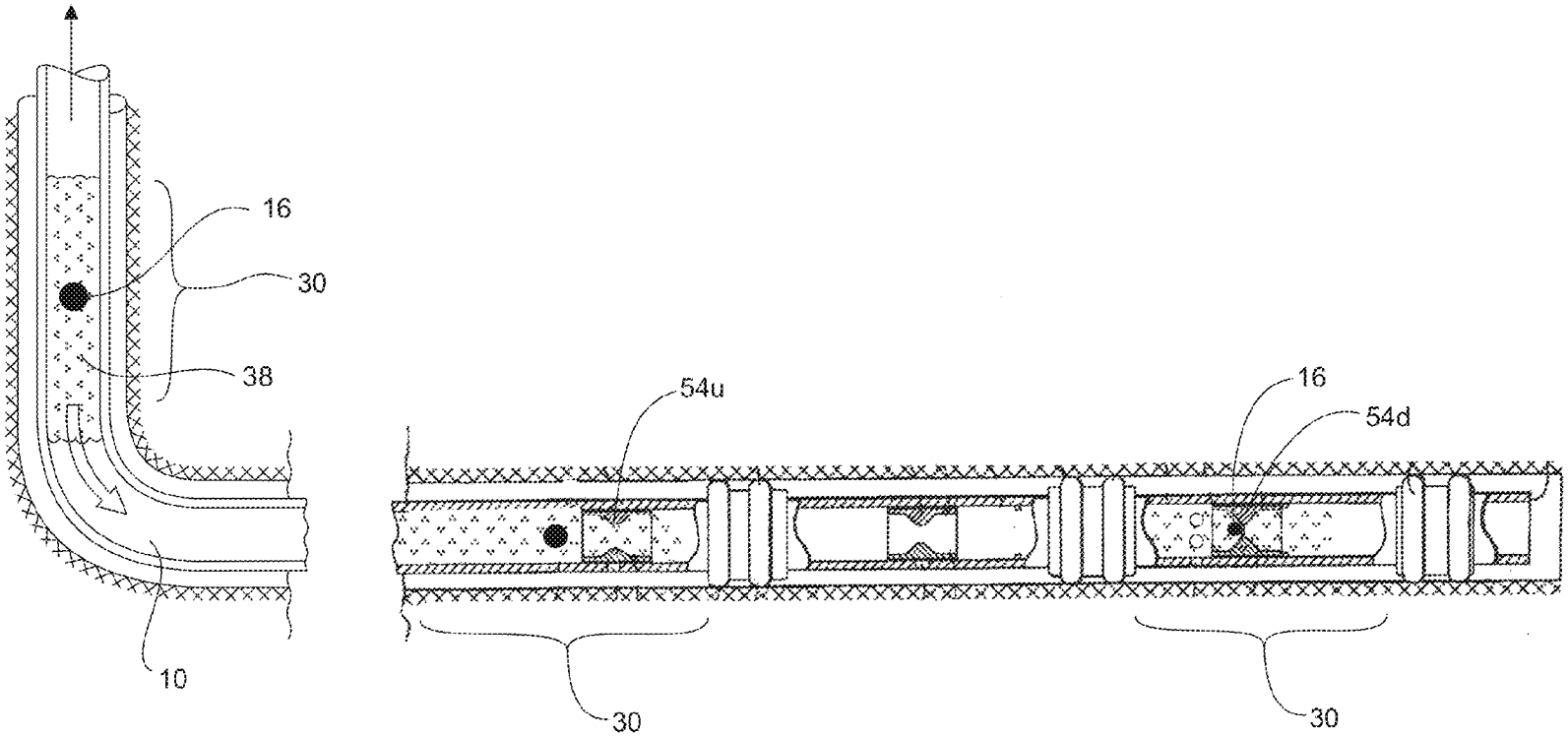
FIG. 10 illustrates a horizontal wellbore having various slugs of carrier medium and respective balls therein, one slug at a lower downhole device, one entering an intermediate tool, and one enroute and approaching the heel.

As shown in FIG. 10, each slug 30 assists with precise transport of a particular ball 16, despite downhole conditions, including bore irregularities and devices. As shown, the slug 30 can transport the ball 16 past the heel 26. The slug 30 is also shown passing through an uphole sleeve 54*u* in an intermediate device just prior to the ball 16 seating for actuation of the intermediate device. The slug 30 is deformable enough to pass the port of a typical ball-actuated sleeve. As shown, a prior ball release and prior slug 30 is shown just having seated in a downhole sleeve 54*d* of a prior device.

In the prior art, a ball 16 would fall at an estimated rate, or could get hung up at obstructions, low spots including sand accumulations. Depending on fracturing fluid flow, density, viscosity and ball density, the balls may arrive downhole faster or slower than estimated. In the instance where the ball is anticipated to actuate a device, typically fracturing fluid flow is slowed just before arrival to lessen impact. If, however, the estimate is incorrect, a slackening of flow rate maybe too late to avoid impact or collision damage to the ball or downhole device.

Instead, using embodiment described herein, the arrival of the slug 30 and associated ball 16 can be precisely determined knowing the bore dimension and fracturing fluid volumes pumped. Further, the arrival time and positioning of low density or "floating" balls and regular density balls can be equally controlled with precision. Knowledge of the location of the ball 16 during transport permits an operator to reduce the velocity of the pumped displacement fluid F as the slug 30 approaches the downhole tool, minimizing the potentially damaging forces of impact of the ball and the tool.

Further, in devices utilizing multiple like-sized balls 16,16 . . . per device, such as a multi-port tool or packer having multiple ball seats, all of the balls for that device can be support on or encapsulated within in a single slug 30. Therefore in the case where it is desirable for several balls 16,16 to arrive at a multi-port packer at about the same time, the multiple balls can be transported in a tight cluster. Thus, open port erosion is minimized or eliminated by ensuring all ports are blocked at substantially the same time. Further, in either single or multi-port devices, the passage of a portion of the slug 30 through the port can aid in cleaning the port or orifice seat from remnants of sand thus creating a better seal face for the packer ball to seat and seal against. Use of a heavy gel-like carrier medium may also aid in the sealing ability.

Figure 11:
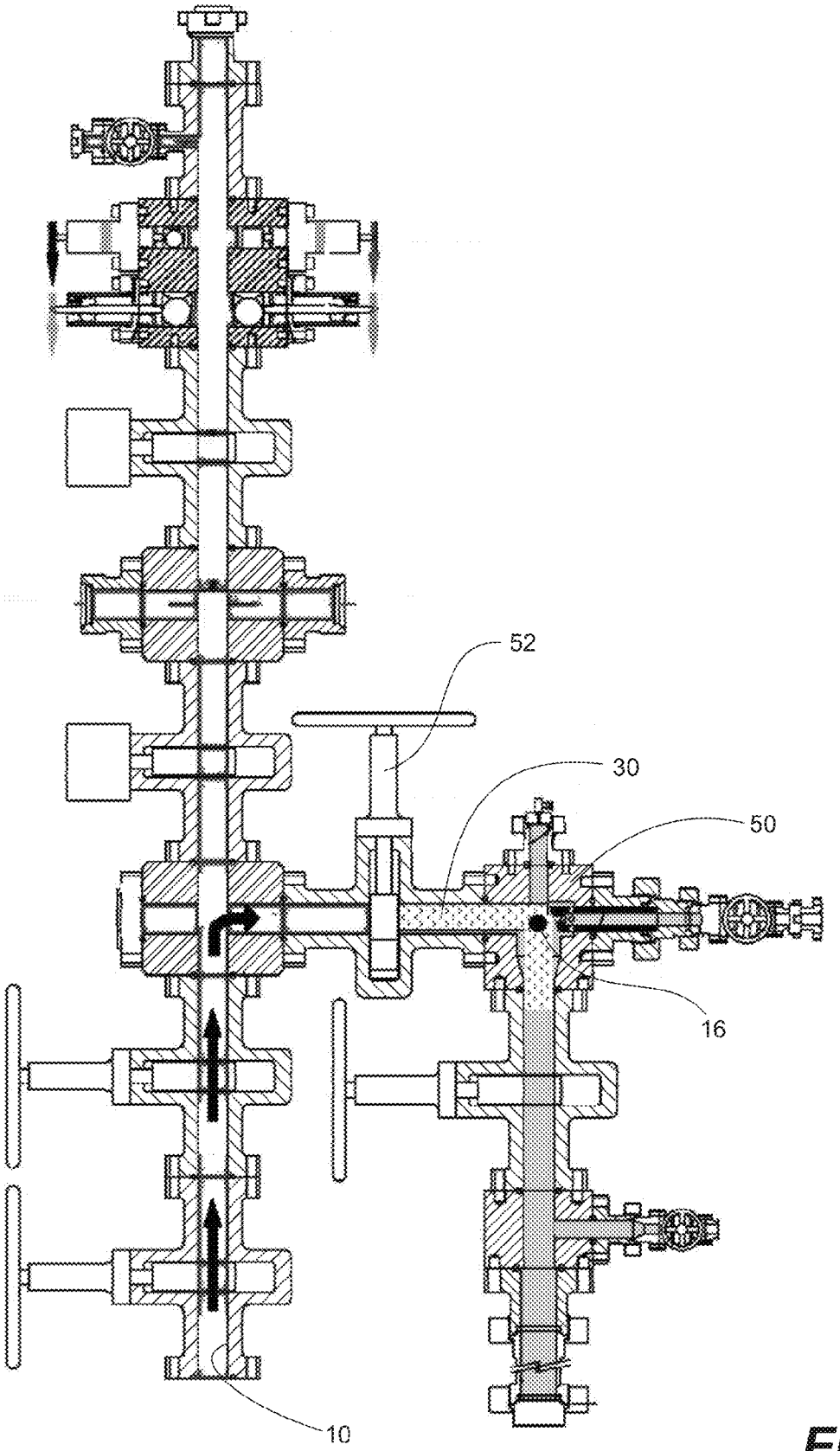
FIG. 11 illustrates the wellhead of FIG. 6 having a slug of carrier medium and supported ball retrieved from downhole and being routed into a ball catching assembly, displacing or advancing any prior balls in the catcher.

In a further embodiment, and as shown in FIG. 11, when fracturing is completed, a reverse fluid flow, including that by reservoir pressure, expels frac fluid, slugs and balls. The slug 30 is expected to remain sufficiently intact to make a return trip up the wellbore 10 during ball retrieval. The ball 16 remains encased or conveyed ahead of the slug 30.

The slug 30 support the ball 16 and assists in a staged recovery of the balls 16 up the wellbore 10, for entrainment and recovery, despite a reverse order of the balls. In the prior art, on recovery, earlier released balls, being lower in the wellbore, and smaller unrestrained balls, had a tendency to jam against larger balls higher in the wellbore, creating a cluster or ball jam at surface equipment. Such ball jamming is quite common with some balls not being recovered at all. Clearing ball jams requires shutting down the fluid flow back, and the resulting time delay caused balls and remnants of sand to drop out which can potentially create sand bridge plugs which then would require potentially costly coil tubing intervention to cleaning out jammed balls and sand accumulation.

Instead, using slugs 30 of carrier medium, each ball 16 is recovered with its respective slug 30, the transport and recovery order being independent of the size of ball 16, each slug acting to maintain separation of successive balls and avoiding jams.

The embodiments of the invention for which an exclusive property or privilege is claimed are defined as follows:

1. A method for delivering at least one actuator to a downhole tool positioned in a wellbore having an actuator injector for injecting the at least one actuator, comprising:

isolating a bore of the actuator injector from the wellbore;

injecting at least a first volume of the carrier medium into the bore;

positioning the at least one actuator into the bore for supporting the at least one actuator within the carrier medium;

opening the bore of the actuator injector to the wellbore; and pumping a displacement fluid into the wellbore for transporting the carrier medium and the supported at least one actuator down the wellbore to the downhole tool.

2. The method of claim 1 wherein supporting the at least one actuator within the carrier medium further comprises, encapsulating the at least one actuator within the carrier medium.

3. The method of claim of 1 further comprising:

introducing the carrier medium into the wellbore;

introducing the at least one actuator into the wellbore for support by the carrier medium; and introducing additional carrier medium into the wellbore, whereby the at least one actuator is encapsulated in the actuator carrier medium.

4. The method of claim 1 wherein:

the downhole tool is a multi-port downhole tool; and the introducing of the at least one actuator into the wellbore further comprises introducing two or more actuators to the carrier medium.

5. The method of claim 1 further comprising retrieving of the at least one actuator from the downhole tool by flowing the carrier medium and supported at least one actuator up the wellbore.

6. The method of claim 1, further comprising:

positioning the carrier medium and actuator downhole of the displacement fluid for transport down the wellbore.

7. The method of claim 6 wherein the pumping of the displacement fluid into the wellbore comprises pumping the displacement fluid into the wellbore uphole of the carrier medium and the supported at least one actuator.

8. The method of claim 6, further comprising injecting a second additional volume of the carrier medium into the bore to encapsulate the at least one actuator therein.

9. The method of claim 6 wherein prior to opening the bore of the actuator injector to the wellbore, further comprising equalizing the pressure of the bore with the pressure of the wellbore.

10. The method of claim 6 further comprising pumping at least a portion of the displacement fluid into the bore of the actuator injector for injecting the carrier medium and the supported at least one actuator into the wellbore.

11. The method of claim 10 wherein the pumping of the displacement fluid into the wellbore comprises pumping the displacement fluid into a frac head between the actuator injector and the wellbore.

12. The method of claim 1 wherein the downhole tool is a multi-port tool and the at least one actuator further comprises multiple like-sized actuators for transport to the downhole tool in a cluster.

13. The method of claim 1 further comprising:

establishing a lineal volume of the wellbore per lineal depth; and pumping a measured volume of fluid into the wellbore;

comparing the measured volume of fluid and a cumulative volume of the lineal volume of the wellbore to locate the carrier medium and the supported at least one actuator in the wellbore.

14. The method of claim 13 further comprising:

providing a displacement fluid pump having a predetermined displacement volume and prior to pumping the displacement fluid into the wellbore for injecting the carrier medium and the supported at least one actuator down the wellbore, further comprising:

injecting the first volume of the carrier medium and positioning the at least one actuator; and Injecting a displacing volume of the carrier medium so as to displace the first volume and the at least one actuator from the actuator injector.

15. The method of claim 1 further comprising swabbing the wellbore with the carrier medium ahead of the at least one actuator.

16. The method of claim 1, wherein the wellbore is provided with an isolation valve having a bore in fluid communication with the wellbore, the introducing of the carrier medium and the at least one actuator into the wellbore further comprises:

isolating the bore of the isolation valve from the wellbore;

injecting at least a first volume of the carrier medium into the bore;

positioning the at least one actuator into the bore; and opening the bore of the isolation valve to the wellbore.

17. The method of claim 1 wherein each of the at least one actuators is a ball.

18. The method of claim 1 wherein the carrier medium is a gel.

19. The method of claim 18 further comprising complexing the gel from the displacement fluid and a complexing additive.

20. The method of claim 1 wherein the carrier medium is a foam.

* * * * *